United States Patent [19]

Holroyd et al.

[11] 3,950,868

[45] Apr. 20, 1976

[54] COVER CLOTH FABRIC

[75] Inventors: George C. Holroyd; Dennis T. Austin, both of Hogansville, Ga.

[73] Assignee: Uniroyal Inc., New York, N.Y.

[22] Filed: Mar. 25, 1974

[21] Appl. No.: 454,494

Related U.S. Application Data

[63] Continuation of Ser. No. 175,933, Aug. 30, 1971, abandoned.

[52] U.S. Cl. ..... 38/66; 57/140 G; 139/426 R; 428/228; 428/257; 428/259; 428/268

[51] Int. Cl.[2] ..... D06F 71/36

[58] Field of Search ..... 161/88, 90, 91, 92, 161/93, DIG. 4; 139/420 A, 420 E, 426; 57/140 G; 38/66, 16, 140; 428/228, 257, 258, 259, 268

[56] References Cited

UNITED STATES PATENTS

| | | | |
|---|---|---|---|
| 2,539,301 | 1/1951 | Foster | 139/420 A |
| 2,951,277 | 9/1960 | Youngs | 161/93 |

*Primary Examiner*—William J. Van Balen
*Assistant Examiner*—James J. Bell
*Attorney, Agent, or Firm*—Herbert A. Stern

[57] ABSTRACT

A fabric in which resin coated glass yarns are interwoven with staple fiber spun synthetic yarns for a cover cloth used upon flatwork ironers. The fabric of the cover cloth has a work engaging surface that is relatively soft so as not to impress its weave upon articles undergoing ironing.

12 Claims, 3 Drawing Figures

INVENTORS
DENNIS T. AUSTIN
BY GEORGE C. HOLROYD
Henry Fleischer

COVER CLOTH FABRIC

This is a continuation of application Ser. No. 175,933, filed Aug. 30, 1971, now abandoned.

The foregoing abstract is neither intended to define the invention disclosed in the specification, nor is it intended to be limiting as to the scope in any way.

BACKGROUND OF THE INVENTION

This invention relates generally to a fabric for cover cloths used upon the rolls of flatwork ironers, and more particularly concerns a fabric having resin coated glass yarns interwoven with staple fiber spun synthetic yarns so as to form a strong, heat resistant fabric having a soft work engaging surface.

Commercial laundries utilize what are termed "flatwork ironers" for finishing sheets, towels, tablecloths, and other articles of flatwork. The typical flatwork ironer includes a plurality of power-driven metal rolls operatively associated with a curved steamheated chest. The ironer rolls are covered with a resilient padding, and surrounding such padding is a cover cloth. The articles being ironed are fed onto a continuous moving apron, which carries them to the steam heated chest and under the padded rolls. As a result thereof, moisture is evaporated and a pressed finish is obtained.

Since temperatures of from 300° to 325°F. can be reached during the ironing operation, the cover cloth is usually manufactured from heat resistant yarns. These temperatures cause relatively inexpensive cover cloths made of cotton fabric to deteriorate rapidly. Hence, a typical cotton fabric cover cloth, when used on a flatwork ironer, will char within a period of about 1 week. This problem was partly solved with the introduction of a cover cloth made from an asbestos fabric as described in U.S. Pat. No. 2,534,818 issued to Holroyd et al. The cover cloth disclosed therein has an average service life of from 6 to 8 months. However, the process for producing lightweight asbestos yarns suitable for weaving requires that the asbestos fibers be blended with a carrier yarn such as cotton or polyester. This process involves strict quality control and is relatively expensive. Hence, the cost of the resulting cover cloth is substantially greater than that of cotton fabric cover cloths. An alternate type of cover cloth made of cotton fabric having a plastic coating applied thereto is disclosed in U.S. Pat. No. 2,704,730 issued to Glatt. This type of cover cloth is relatively weak and stiff, and in addition, is expensive to fabricate. Furthermore, a cover cloth of plastic coated cotton may tend to impress its weave on an article undergoing ironing.

In order to overcome many of the disadvantages associated with conventional fabrics heretofore utilized for cover cloths, it has been found desirable, in accordance with the present invention, to provide a cover cloth made from a fabric having resin coated glass yarns interwoven with synthetic yarns.

Accordingly, it is a primary object of the present invention to provide a strong, heat resistant fabric from which a cover cloth used on flatwork ironer rolls may be manufactured.

Another object of the present invention is to provide a cover cloth fabric for flatwork ironer rolls which is relatively economical to manufacture, and has an appreciably longer life than cover cloth fabrics of the type hereinbefore used.

A further object of the present invention is to provide a cover cloth fabric which does not impress its weave upon articles undergoing ironing.

SUMMARY OF THE INVENTION

Briefly stated and in accordance with the present invention, there is provided a fabric for cover cloths used upon flatwork ironer rolls. The fabric is made preferably from a plurality of staple fiber spun synthetic yarns interwoven with a plurality of resin coated glass yarns. It is also preferable to weave the cover cloth fabric in such a manner that the work engaging surface thereof is preferably formed mainly from the staple fiber spun synthetic yarns. In this way, the work engaging surface of the fabric is maintained at a controlled smoothness that does not impress its weave upon articles undergoing ironing. In contrast, the back surface thereof is preferably formed mainly of resin coated glass yarns. The glass yarns have a high tensile strength and thereby increase the strength of the cover cloth fabric. Thus, it is apparent that each of the yarns utilized complements the other so as to impart to the cover cloth fabric made therefrom qualities hereinbefore not attainable.

In accordance with a further aspect of this invention, there is applied a resin coating to the back surface of the fabric of the cover cloth. The resin coating applied thereto locks the staple fiber spun synthetic yarns and resin coated glass yarns in place, thereby producing a stronger and longer wearing cover cloth fabric which is resistant to distortion.

BRIEF DESCRIPTION OF THE DRAWINGS

Other objects and advantages of this invention will become apparent upon reading the following detailed description and upon reference to the drawings in which.

While this invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
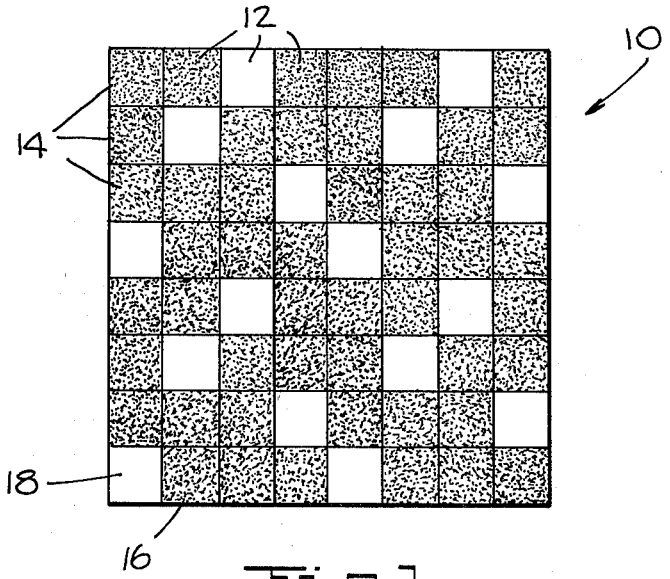
FIG. 1 is a weave diagram illustrating schematically the interlacing of the filling yarns with the warp yarns of a cover cloth fabric constructed in accordance with the preferred embodiment of the present invention.

With continued reference to the drawings, wherein like reference numerals have been used throughout to designate like elements, FIG. 1 illustrates a weave diagram which has been employed to further facilitate the description of this invention. As shown therein, the cover cloth fabric, designated generally at 10, includes a plurality of warp yarns 12 interwoven with a plurality of filling yarns 14.

The interlacing of warp 12 and filling 14 is indicated in the weave diagram of FIG. 1 by darkening certain squares while others remain blank. When a square is darkened, it indicates that the warp end represented by that vertical row of squares is lifted at the point and that the pick of filling represented by the horizontal row of squares is underneath the warp end; for instance in FIG. 1 the square 16, on the second end and first pick, is darkened indicating that the second end is raised over the first pick. On the other hand, when a square is left blank it indicates that the warp end represented by that vertical row of squares is lowered at that point and that the pick of filling represented by that horizontal row of squares is over the warp end. Referring once again to FIG. 1, the square 18, on the first end and first pick, is blank indicating that the first end is lowered under the first pick. Thus, the darkened in squares always mean warp end up and the blank squares mean pick up.

Figure 2:
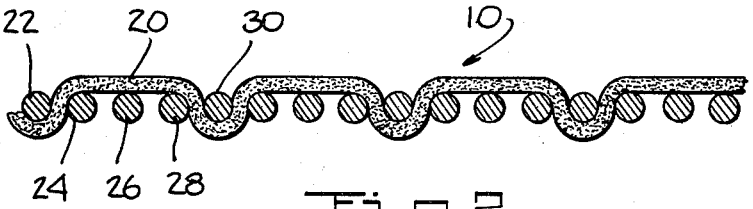
FIG. 2 is a fragmentary, sectional view showing the interlacing of one of the filling yarns with the warp yarns of the cover cloth fabric constructed in accordance with the weave depicted in the FIG. 1 weave diagram.

All weaves repeat in a certain number of ends and picks. For example, in the preferred embodiment of this invention the weave repeats on 4 ends and 4 picks. To further illustrate this point, FIG. 2 shows one of the picks of filling interlacing with the warp ends. As depicted in FIG. 2, pick of filling 22 is lifted and warp end 20 is underneath pick 22. Thereupon, the following three successive picks 24, 26 and 28, respectively, are lowered and warp end 20 is over picks 24, 26 and 28. Thereafter, the weave repeats in the same manner as was heretofore described, i.e., pick of filling 30 is lifted and warp end 20 is under pick 30. Hence it is clear that the weave, as shown in FIGS. 1 and 2, repeats on four ends and four picks.

The warp yarns 12 are preferably synthetic yarns made of staple fibers that are spun in a suitable manner. In this way, the warp yarns 12 formed thereby are relatively "soft," whereas continuous filament yarn would be relatively "hard." It is apparent, therefore, that a fabric having its work engaging surface formed mainly of hard yarns tend to impress its weave upon articles undergoing ironing. In contrast, however, according to the preferred embodiment of the present invention, the fabric 10 has its work engaging surface formed mainly from soft yarns so as not to impress its weave upon an article undergoing ironing. Thus, warp yarns 12 are preferably staple fiber spun synthetic yarns, such as polyester or polyamide yarns, or other relatively soft heat resistant yarns. The staple fiber spun synthetic yarns 12 include preferably fibers selected from the group of fibers consisting of polyester (e.g., Terylene and Dacron) and polyamide (nylon) fibers. Filling yarns 14 are preferably resin coated glass yarns or other suitable yarns of comparative high tensile strength. In this manner, the filling yarns 14 are relatively strong so that the fabric 10 formed therefrom is long wearing. It is evident that the staple fiber spun synthetic yarns 12 cooperate with the resin coated glass yarns 14 so that the fabric 10 made therefrom is strong, heat-resistant, and long wearing, while the work engaging surface thereof does not impress its weave upon articles undergoing ironing. The yarns here employed are capable of withstanding the high temperature (a minimum of 300°F.) and wear resulting from months of use as cover cloth fabric on flatwork ironer rolls. The weave shown in FIGS. 1 and 2 is a typical floating weave commonly known as the "warp-flush broken crow" twill weave with three up and one down. While it is not essential that this particular type of weave be employed it is highly desirable that a floating weave be used so that the work engaging surface of fabric 10 will be formed mainly of staple fiber spun synthetic yarns 12. As hereinbefore described synthetic yarns 12 are preferably relatively soft, and, therefore, have a "twist multiplier" which ranges from about 1.5 to 2.5, the preferred twist multiplier being about 2. The term twist multiplier is a measurement of the relative softness of the yarn and is defined as the number of turns per unit length of yarn (turns per inch) divided by the square root of the yarn number. The synthetic yarns 12 occupy between approximately 60 and 80% of the total surface area of the work engaging surface of cover cloth fabric 10. Preferably, synthetic yarns 12 occupy about 75% of the total surface area of the work engaging surface of cover cloth fabric 10. Thus, on the work engaging surface, synthetic yarns 12 have a surface area which ranges preferably from about 1.5 times to about 4.5 times the surface area of glass yarns 14, and synthetic yarns 12 have a surface area which is preferably about 3 times the surface area of glass yarns 14. In this manner, the work engaging surface of cover cloth fabric 10 is regulated so as to be a relatively soft surface that does not impress its weave on articles undergoing ironing. Conversely, the back surface of cover cloth fabric 10 is preferably formed mainly of resin coated glass yarns 14 and, therefore, is relatively strong and heat resistant.

As indicated previously, filling 14 is a continuous filament glass yarn, each of the filaments of glass yarn being individually coated prior to weaving with a suitable resin. Resorcinol formaldehyde latex is the preferred resin for coating the glass yarn, however, any other suitable organic resin may also be used therefor. The resin coating protects the glass yarn from degradation due to moisture and from mutual abrasion of the individual filaments. It also prevents the formation of skin irritations on the hands of operators using cover cloths made from fabric having glass yarns therein.

The wearing properties of fabric 10 can be still further improved and the life thereof increased, by treating the back surface of woven fabric 10 with a suitable resin so as to lock the synthetic and glass yarns, 12 and 14, respectively, in place. Although various resins may be employed to coat fabric 10, it is desirable to use phenolic varnish sold under the trademark Bakelite BKS-4035 by the Union Carbide Corporation of Charleston, W.Va.. The coating may be prepared by diluting the phenolic varnish with methylethylketone and toluene at room temperature until the requisite viscosity is obtained, i.e., the varnish is slightly fluid in character but does not strike through the fabric. Thereafter, the varnish is applied to the back surface of fabric 10 by conventional methods, for example by placing the varnish on fabric 10 and then passing fabric 10 and the varnish placed thereon over a support member and under a suitable coating knife closely spaced thereto. The coating knife spreads the varnish uniformly across substantially the entire width of the back surface of fabric 10, and controls the weight of varnish material applied thereto simultaneously therewith. Fabric 10, having the uncured varnish applied thereto, is thereupon passed over a support roller into an oven at a speed that is sufficiently fast. (for example 10 yards per minute) so as to insure that the varnish does not soak through to synthetic yarns 12 on the work engaging surface. The oven heats the back surface of fabric 10 and the uncured varnish coating to approximately 350°F. for about 2 minutes so as to evaporate the volatile liquids in the varnish. The back surface of fabric 10 is then cooled or allowed to cool until the varnish coating is no longer tacky. It is preferable to cool the varnish coated back surface to substantially room temperature. The solidified varnish locks the yarns of the back surface of fabric 10 in place so as to provide a long wearing, heat resistant fabric for cover cloths used on flatwork ironer rolls.

Figure 3:
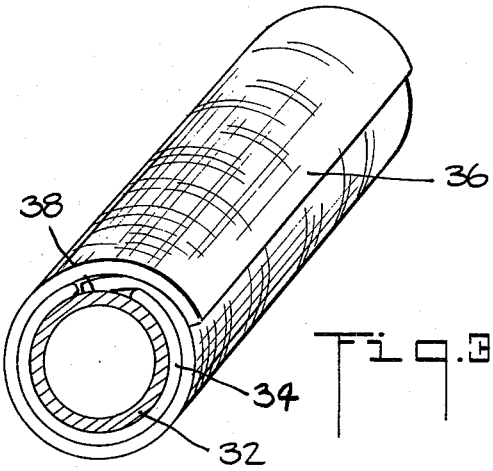
FIG. 3 is a sectional perspective view of a flatwork ironer roll covered with a cover cloth made from the fabric of this invention.

Turning now to FIG. 3, there is shown a conventional metal ironer roll 32 having a layer of padding 34 wound thereabout. Over padding 34 is secured a finished cover cloth 36 which is made of fabric 10 illustrated in FIGS. 1 and 2. Various means may be employed to secure cover cloth 36 in place upon ironer roll 32, and in the embodiment depicted in FIG. 3, the inner marginal edge portion of cover cloth 36 is secured adhesively by a suitable cement directly to roll 32 at surface 38 thereof. Cover cloth 36 is shown as contacting surface 38 of roll 32 at an angle of approximately 45°. Thereafter, cover cloth 36 is wound in an outwardly extending direction so as to pass between the slightly spaced edges of padding 34 and over padding 34 for at least one complete revolution. The outer marginal edge portion of cover cloth 36 is free so that it may slip upon the underlying winding as it stretches and the padding packs down. In use, ironer roll 32 is rotated such as to draw padding 34 and cover cloth 36 tightly about roll 32.

In the preferred embodiment, fabric 10 has the following physical properties:

EXAMPLE 1

| | |
|---|---|
| Weight | 17.0 ozs. per square yard |
| Gauge | 0.0365 |
| Ends per inch - Polyester | 44.8 |
| Picks per inch - Glass | 17.0 |
| Broken Twill weave | 3 up 1 down |
| Percentage weight - Polyester | 46% |
| Percentage weight - Glass | 54% |
| Tensile strength - Polyester | 590.0 lbs. per inch |
| Tensile strength - Glass | 625.0 lbs. per inch |
| Twist multiplier - Polyester | 2 |

Another embodiment of fabric 10 has the following physical properties:

EXAMPLE 2

| | |
|---|---|
| Weight | 16.0 ozs. per square yard |
| Gauge | 0.0365 |
| Ends per inch - Polyester | 44.8 |
| Picks per inch - Glass | 17.0 |
| Satin Weave | 3 up 1 down |
| Percentage weight - Polyester | 46% |
| Percentage weight - Glass | 54% |
| Tensile strength - Polyester | 594.0 lbs. per inch |
| Tensile strength - Glass | 720.0 lbs. per inch |
| Twist multiplier - Polyester | 2 |

The glass yarn 14 of Examples 1 and 2 is preferably 5 strand, 0 twist, continuous filament yarn, the length of strand in 1 lb. of yarn being about 7,500 yards. Similarly polyester yarn 12 of Examples 1 and 2 is preferably 10 count, 2 ply yarn having 12.35 single turns per inch in the Z-direction and 5.7 ply turns per inch in the S-direction.

A further embodiment of fabric 10 has the following physical properties:

EXAMPLE 3

| | |
|---|---|
| Weight | 16.84 ozs. per square yard |
| Gauge | 0.0434 |
| Ends per inch - Polyester | 24.0 |
| Picks per inch - Glass | 17.0 |
| Broken twill weave | 3 up 1 down |
| Percentage weight - Polyester | 56% |
| Percentage weight - Glass | 44% |
| Tensile strength - Polyester | 756.0 lbs. per inch |
| Tensile strength - Glass | 600.0 lbs. per inch |
| Twist Multiplier - Polyester | 1.5 |

Similarly, the glass yarn 14 of Example 3 is preferably 5 strand, 0 twist continuous filament yarn, the length of strand in 1 lb. of yarn being about 7,500 yards. While polyester yarn 12 of Example 3 is preferably 4.05 count, 2 ply yarn havng 8.30 single turns per inch in the Z-direction and 5.2 ply turns per inch in the S-direction.

Still a further embodiment of fabric 10 has the following physical properties:

EXAMPLE 4

| | |
|---|---|
| Weight | 15.43 ozs. per square yard |
| Gauge | 0.0434 |
| Ends per inch - Polyester | 26.4 |
| Picks per inch - Glass | 19.7 |
| Chain weave | 2 up 2 down |
| Percentage weight - Polyester | 64% |
| Percentage weight - Glass | 36% |
| Tensile strength - Polyester | 728 lbs. per inch |
| Tensile strength - Glass | 438 lbs. per inch |
| Twist multiplier - Polyester | 1.5 |

The glass yarn 14 of Example 4 is preferably 3 strand, 0 twist, continuous filament yarn with the length of strand in 1 lb. of yarn being about 7,500 yards. Polyester yarn 12 of Example 4 is preferably also 4.05 count, 2 ply yarn having 8.30 single turns per inch in the Z-direction and 5.2 ply turns per inch in the S-direction.

Although synthetic yarns (polyester and polyamide) and glass yarns are the preferred yarns mentioned herein for use in fabric 10 of cover cloth 36, it is to be understood that other relatively soft yarns, such as acrylic, may be interwoven with other yarns having relatively high tensile strength, such as high tenacity nylon or high tenacity polyester, so as to form the cover cloth 36 disclosed herein.

Cover cloth 36 of Example 2 was subjected to extensive testing, and, in actual use on flatwork ironer rolls was found to have a useful life in excess of 8 months. In addition, the cost of the cover cloth disclosed herein is about one-third the cost of the typical asbestos cover cloth. Furthermore, cover cloth 36 of this invention has about 3 times the tear strength of the conventional asbestos cover cloth.

Hence, it is apparent from the foregoing that the cover cloth fabric described herein has numerous properties which are superior to cover cloth fabrics used hereinbefore. The new and improved cover cloth fabric of this invention is more economical to manufacture, while being stronger and having a longer life than other cover cloth fabrics. Moreover, the work engaging surface of the cover cloth fabric is maintained at a controlled smoothness by having staple fiber spun synthetic yarns interwoven with glass yarns which are individually pre-coated with a resin such that the work engaging surface thereof is formed mainly of the softer synthetic yarns. In this manner the smoothness of the work engaging surface of the cover cloth fabric is regulated so as not to impress its weave upon articles being ironed.

Thus it is apparent that there has been provided a fabric for cover cloths used on flatwork ironer rolls that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

Having thus described our invention, what we claim and desire to protect by Letters Patent is:

1. In combination, an ironer roll and a cover cloth fabric wound thereabout, said cover cloth fabric comprising:

a plurality of staple fiber spun synthetic yarns; and a plurality of glass yarns, each of said plurality of glass yarns being individually pre-coated with a resin, said plurality of pre-coated glass yarns being interwoven with said synthetic yarns so that the major portion of the back surface of the fabric is formed of said pre-coated glass yarns and the major portion of the work engaging surface of the fabric is formed of said synthetic yarns to thereby impart a controlled smoothness to the work engaging surface thereof which does not impress its weave upon an article being ironed.

2. The combination as recited in claim 1, further comprising a resin coating applied substantially uniformly on substantially the entire back surface of the woven fabric so as to improve the wear and distortion resistance of the fabric by locking said synthetic yarns and said glass yarns in place.

3. The combination as recited in claim 2, wherein said synthetic yarns include fibers selected from the group consisting of polyester and polyamide fibers.

4. The combination as recited in claim 3, wherein the work engaging surface of said fabric comprises said synthetic yarns having a surface area which is preferably in the range of from about 1.5 times to about 4.5 times the surface area of said glass yarns.

5. The combination as recited in claim 4, wherein the work engaging surface of said fabric comprises said synthetic yarns having a surface area which is preferably about 3 times the surface area of said glass yarns.

6. The combination as recited in claim 4, wherein said synthetic yarns have a twist multiplier which is preferably in the range of from about 1.5 to about 2.5.

7. The combination as recited in claim 6, wherein said synthetic yarns have a twist multiplier which is preferably about 2.

8. The combination as recited in claim 3, wherein said individually pre-coated glass yarns comprise a plurality of continuous filament fibers.

9. The combination as recited in claim 3, wherein each one of said synthetic yarns are made from two ply yarn.

10. The combination as recited in claim 3, wherein said synthetic yarns are interwoven with said individually pre-coated glass yarns in a floating weave.

11. The combination as recited in claim 1 wherein the staple fiber spun synthetic yarns constitute the warps of said fabric and the individually pre-coated glass yarns are continuous filament yarns and constitute the picks of said fabric.

12. The combination as recited in claim 1 wherein the resin pre-coating said individual glass yarns is resorcinol formaldehyde latex.

* * * * *